US011331920B2

(12) United States Patent
Borrego Lebrato et al.

(10) Patent No.: US 11,331,920 B2
(45) **Date of Patent: *May 17, 2022**

(54) PRINTHEAD CLEANING

(71) Applicant: HP SCITEX LTD., Netanya (IL)

(72) Inventors: Alberto Borrego Lebrato, Sant Cugat del Valles (ES); Jordi Lluch, Sant Cugat del Valles (ES); Gabriel Teijeiro, Sant Cugat del Valles (ES)

(73) Assignee: HP SCITEX LTD., Netanya (IL)

( * ) Notice: Subject to any disclaimer, the term of this patent is extended or adjusted under 35 U.S.C. 154(b) by 0 days.

This patent is subject to a terminal disclaimer.

(21) Appl. No.: 17/129,505

(22) Filed: Dec. 21, 2020

(65) Prior Publication Data

US 2021/0107287 A1 Apr. 15, 2021

Related U.S. Application Data

(63) Continuation of application No. 16/547,148, filed on Aug. 21, 2019, now Pat. No. 10,875,310.

(30) Foreign Application Priority Data

Sep. 27, 2018 (EP) ..... 18197070

(51) Int. Cl.
*B41J 2/165* (2006.01)

(52) U.S. Cl.
CPC ..... *B41J 2/16535* (2013.01)

(58) Field of Classification Search
CPC ..... B41J 2/16535; B41J 2/16544; B41J 2/16541; B41J 2/16538; B41J 2/16547; B41J 2002/1655; B41J 2002/16558
See application file for complete search history.

(56) References Cited

U.S. PATENT DOCUMENTS

| | | | | |
|---|---|---|---|---|
| 2,928,465 | A | 3/1960 | Wrist | |
| 5,851,358 | A | 12/1998 | Kade | |
| 6,775,925 | B2 | 8/2004 | Zagar | |
| 7,748,392 | B2 | 7/2010 | Balthazor | |
| 9,296,211 | B2 | 3/2016 | Ozaki | |
| 10,875,310 | B2 * | 12/2020 | Borrego Lebrato | B41J 2/16541 |
| 2011/0080447 | A1 | 4/2011 | Seshimo | |
| 2013/0002756 | A1 | 1/2013 | Kriz | |

(Continued)

FOREIGN PATENT DOCUMENTS

| | | |
|---|---|---|
| DE | 2705328 | 8/1978 |
| EP | 2735646 A1 | 5/2014 |

(Continued)

*Primary Examiner* — Kristal Feggins
(74) *Attorney, Agent, or Firm* — HP Inc. Patent Department

(57) ABSTRACT

In an example of the disclosure, a cleaning system for a printhead includes a web of material movable in a web direction. The web has a first side for wiping a printhead face. The cleaning system includes a dispensing apparatus to dispense a liquid upon the web. The cleaning system includes a scraper element for scraping liquid from the web and includes a collector element with a trough. The collector element is to cause collection of liquid scraped from the web to collect in the trough. The cleaning system includes a pusher element to push against the second side of the web and thereby cause the first side of the web to wipe the printhead face.

20 Claims, 8 Drawing Sheets

(56) References Cited

U.S. PATENT DOCUMENTS

| | | | |
|---|---|---|---|
| 2017/0120600 | A1 | 5/2017 | Yamanobe |
| 2017/0253044 | A1 | 7/2017 | Ohnishi |
| 2018/0126737 | A1 | 5/2018 | Asano |

FOREIGN PATENT DOCUMENTS

| | | | |
|---|---|---|---|
| JP | 2012051140 | | 3/2012 |
| WO | WO-9635584 | A1 | 11/1996 |

* cited by examiner

PRINTHEAD CLEANING

CROSS-REFERENCE TO RELATED APPLICATION(S)

This application is a Continuation of commonly assigned and co-pending U.S. patent application Ser. No. 16/547,148, filed Aug. 21, 2019, which claims priority to European Application Serial Number 18197070.8, filed Sep. 27, 2018, the disclosures of which are hereby incorporated by reference in their entireties.

BACKGROUND

Printing systems, such as inkjet printers, may include one or more printheads. Each printhead includes a printhead face having a series of nozzles that are used to spray drops of print agent upon a substrate. During operation of the printing systems, the printhead face may accumulate contaminants such as dried printing fluid or drying ink. Such contaminants can partially or completely clog nozzles so as to severely affect the performance of the printing system and print quality.

DRAWINGS

DETAILED DESCRIPTION

Figure 1:
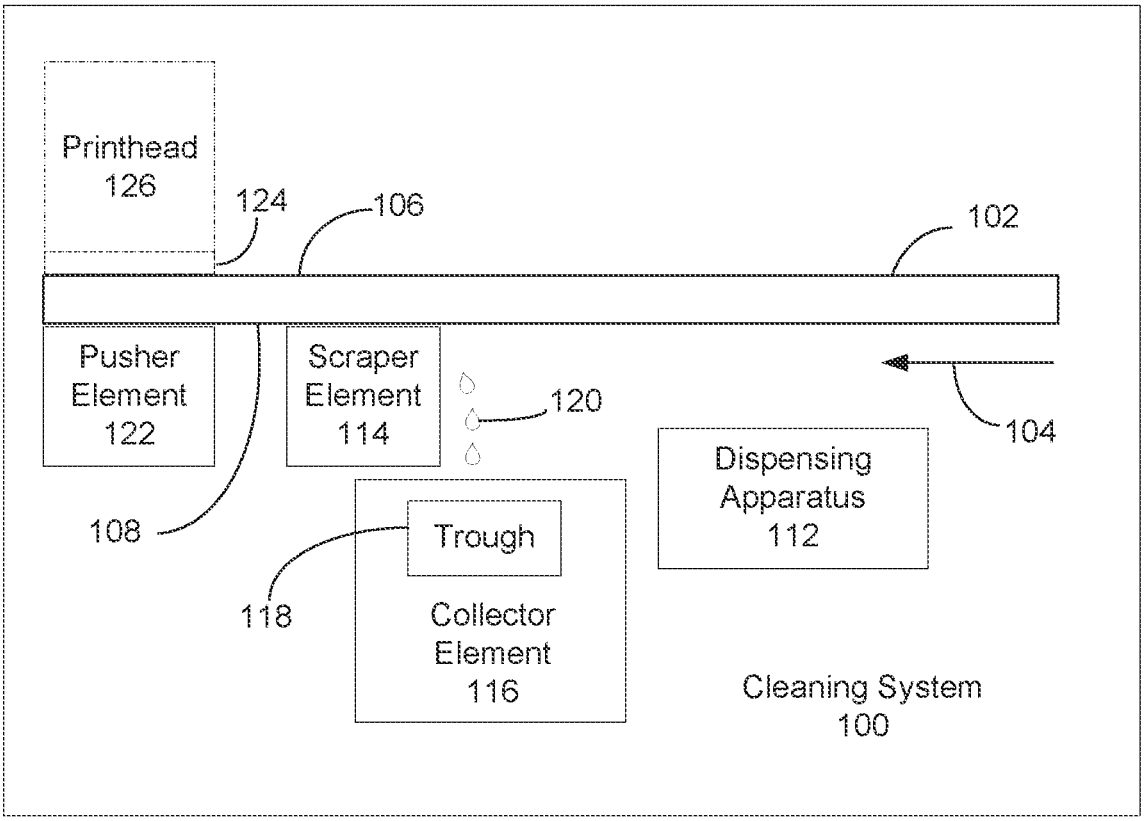
FIG. 1 is a simple schematic diagram that illustrates a side view of an example of a printhead cleaning system.

In some printer systems, an issue of issue of dried ink and other contaminants accumulating at printhead nozzles is addressed by utilizing a moistened web, e.g., a moistened fabric web, to periodically wipe the printhead nozzles. As liquid is applied to moisten the web, however, excess liquid can accumulate so as to over-saturate the web and significantly affect printing operations. Forces exerted between a wiper or other pushing element that urges the web to clean the printhead face, and the face of the printhead itself, can cause a squeezing effect upon the web that exacerbates the issue of excess liquid dripping from the web. The excess liquid at the web can diminish the effectiveness of the cleaning operation. Further, in some examples liquid dripping from an over-saturated web will cause damage to sensitive electronic components, resulting in increased printing costs and repair downtime.

One approach for minimizing excess liquid at the cleaning web has been to have a printhead cleaning or servicing component with sensors and highly controllable fluid distribution devices to precisely apply the liquid to the web. Other approaches may include having a sheath to cover the printer's electronics from dripping liquid, and having a dryer system to remove excess liquid from the cleaning web. With each of these approaches, however, expense can be an issue as the feedback loop components, the sheath, and/or the drying components can add expense to a printer's bill of materials and operating costs.

To address these issues, various examples described in more detail below provide a new system and a method for cleaning a printhead. In an example of the disclosure, a printhead cleaning system includes a web of material that is movable in a web direction. The web has a first side for wiping a face of a printhead and a second side opposite the first side. The system includes a dispensing apparatus to dispense a liquid upon the web. The system includes a scraper element for scraping liquid from the web. The scraper element is positioned adjacent to the second side of the web, downstream of the dispensing apparatus, and upstream of the printhead face. The system includes a collector element with a trough. The collector element is to cause collection of liquid that was scraped from the web by the scraper element into the trough. The system includes a pusher element that is to push against the second side of the web and thereby cause the first side of the web to wipe the printhead face. In an example, the printhead face includes a set of nozzles, such that the first side wiping of the printhead face is a wiping of the printhead nozzles.

In this manner the disclosed method and system enables establishment of optimal wetting conditions for a cleaning web for printheads. Nozzles of the printhead can be effectively wiped without the dripping of excess liquid that can cause reduce the effectiveness of the cleaning operation and cause shorting of the printer's electrical systems. Users and providers of inkjet printer systems and other printer systems will appreciate the improvements in print quality, the increasing of the useful life of printheads, the efficient cleaning cycles, and the reductions in print apparatus downtime that are afforded by utilization of the disclosed examples. Installations and utilization of printers that include the disclosed method and system should thereby be enhanced.

FIG. 1 illustrates an example of a system 100 for cleaning a printhead. In this example, system 100 includes a web 102 of material that is movable in a web direction 104. As used herein, a "web" refers generally to a flexible material that is to be moved by a driver system. In an example, the web 102 may be a web of fabric that is to be moved via a set of rollers from a feeder spindle to a take-up spindle. In another example, web 102 may be a continuous web (e.g., a continuous belt) of fabric that is to be driven by a set of rollers. As used herein, "fabric" refers generally to a material that includes a cloth or other material produced by a weaving, knitting, or felting of textile fibers.

Web 102 has a first side 106 for wiping a face 124 of a printhead 126 and a second side 108 opposite the first side. As used herein, a "printhead" refers generally to a mechanism for ejection of a print agent. As used herein, "print agent" refers generally to any substance that can be applied upon a media by a printer during a printing operation, including but not limited to primers and overcoat materials (such as a varnish). As used herein, a "primer" refers generally to any substance that is applied to a substrate as a preparatory coating in advance of application of ink to the substrate length. As used herein an "ink" refers generally to a fluid that is to be applied to a media during a printing operation to form an image upon the media. In examples, the applied primer may be a water-soluble polymer. As used herein an "overcoat" refers generally to any substance that is applied to a substrate as a protective or embellishment coating after a printing device has applied an ink film to the substrate to form an image. In examples the overcoat may be a transparent ultraviolet ("UV") coating that is applied to the web substrate and then cured utilizing an ultraviolet light. In other examples, the overcoat may be an aqueous clear varnish applied without a UV curing process. As used herein, a "printhead face" refers to a portion of the printhead that has nozzles or other orifices for ejection of a print agent. The printhead face is to face, e.g., to be positioned in front of or opposing, a substrate at the time the printhead is to eject the print agent upon the substrate.

Continuing at FIG. 1, system 100 includes a dispensing apparatus 112 that is to dispense a liquid upon web 102. In certain examples, the liquid distributed by dispensing apparatus is water. In other examples, the liquid distributed by dispensing apparatus 112 may be a cleaning solution. In various examples, dispensing apparatus 112 may be a dripping unit or a jetting unit. As used herein, "jetting", or to "jet" a liquid refers generally to spraying, squirting, streaming, spurting, gushing or otherwise ejecting or propelling a liquid.

In examples, dispensing apparatus 112 may include a piston inserting system, a diaphragm pump, a gear pump, a syringe, or any other liquid distribution system. In the example of FIG. 1, dispensing apparatus 112 is situated adjacent to second side 108 of web 102 so as to apply a liquid to second side 108. In other examples, the dispensing apparatus may be situated adjacent to first side 106 of web 102 so as to apply the liquid to first side 106. In another example, the dispensing apparatus could be positioned adjacent to an edge of web 102, so as to apply fluid contemporaneously to first side 106 and second side 108 of web 102.

Continuing at FIG. 1, system 100 includes a scraper element 114 for scraping excess liquid from web 102. As used herein, a "scraper" refers generally to any a tool or device used to be remove a substance from a medium via a pushing or pulling engagement with the medium. In this example, scraper element 114 is positioned adjacent to second side 108 of web 102, downstream of dispensing apparatus 112, and upstream of the face 124 of the printhead 126 that is to be wiped by web 102. Scraper element 114 is to engage excess or pooled liquid at second side 108 of web 102. In certain examples, scraper element 114 is to cause removal of excess or pooled liquid from first side 106 of web 102 as well as excess pooled liquid situated at second side 108 of web 102, due to porosity of the web 102 and capillarity of the excess or pooled liquid.

System 100 includes a collector element 116 with a trough 118. Collector element 116 to cause collection of liquid 120 that has been scraped from the web by scraper element 114 into trough 118. In certain examples, scraper element 114 and collector element 116 may be contiguous elements. For instance, in one example, scraper element 114 may a molded plastic element that is adhered to collector element 116. In another example, scraper element 114 may be a sharpened edge of collector element 116, wherein this sharpened edge is situated for scraping second side of web 102 and causing the scraped liquid to flow into or otherwise be collected by collection element 118.

System 100 includes a pusher element 122 to push against second side 108 of web 102 and thereby cause first side 106 of the web 102 to wipe the face of printhead 126. In an example where printhead face 124 includes a set of printhead nozzles, first side 106 of web 102 is to wipe the printhead nozzles.

Figure 2:
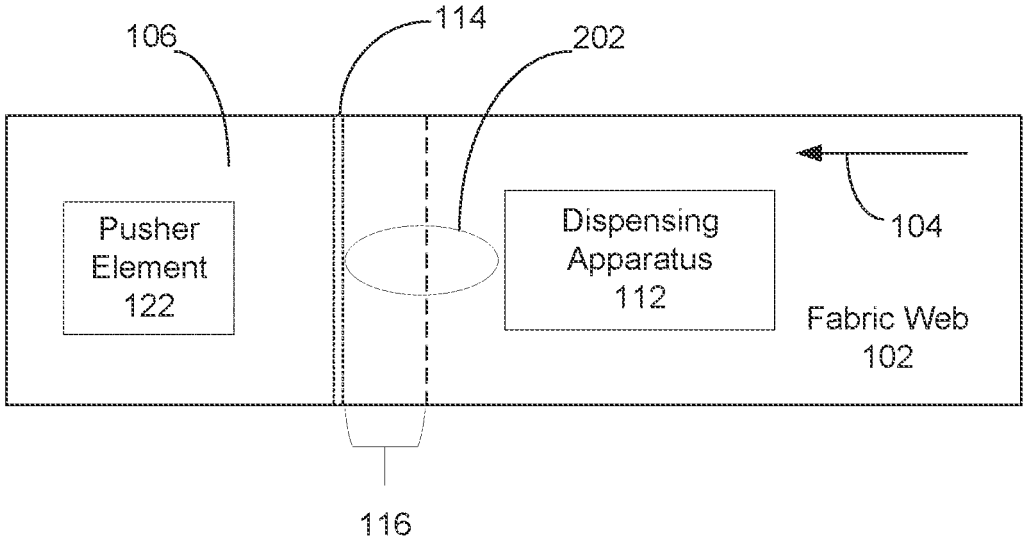
FIG. 2 is a simple schematic diagram that illustrates a top down view of an example of a printhead cleaning system.

FIG. 2 is a simple schematic diagram that illustrates a top down view of an example printhead cleaning system. In the example of FIG. 2, system 100 includes a fabric web 102 movable in a web direction 104. Fabric web 102 has a first side 106 for wiping nozzles of a printhead (not included in FIG. 2) and a second side of web 102 (not visible in FIG. 2) opposite the first side 106. System 100 includes a dispensing apparatus 112 that is to dispense a liquid 202, e.g., water, upon first side 106 of web 102. In another example, dispensing apparatus 112 may be situated beneath web 102 to or otherwise apply a liquid to the second side of web 102.

Continuing with the example of FIG. 2, system 100 includes a scraper element 114 situated beneath web 102 to engage the second side of web 102 to scrape excess liquid from web 102. In FIG. 2 scraper 114 is denoted with hashed lines as it is situated across and at the underside of the depicted web 102. Scraper 114 has a sharp edge to engage excess or pooled liquid at the second side web 102. In this example web 102 is a porous fabric web, and scraper element 114 is to cause removal of excess or pooled liquid from both first side 106 and the second side of web 102 due to the capillary properties of the liquid 102 and the porosity of web 102.

Continuing with the example of FIG. 2, system 100 includes a collector element 116 with a trough. In FIG. 2 collector element 116 is denoted with hashed lines as it is at the underside of the depicted web 102. Collector element 116 to cause collection of liquid that has been scraped from web 102 by scraper element 114 into the collector element's trough.

System 100 includes a pusher element 122 situated adjacent to the second side of web 102 to push against the second side of web 102. In FIG. 2 pusher element 122 is denoted with hashed lines as it is at the underside of the depicted web 102. This pushing is to cause first side 106 of web 102 to engage and wipe the nozzles of the printhead (not shown in FIG. 2).

FIGS. 3A-3D are simple schematic diagrams that illustrate an example of a system for printhead cleaning. Beginning at FIG. 3A, in this example printhead cleaning system 100 includes a cleaning web 102 with a first side 106 for engaging a set of nozzles situated upon a face 124 of printhead 126. In this example, system 100 includes a dispensing apparatus 112 that is situated adjacent to a second side 108 of web 102 (opposite the first side) and that is to jet a liquid 302 upward to second side 108 of web 102 to moisten the cleaning web. Cleaning web 102 is to move in a web direction 104.

Figure 3A:
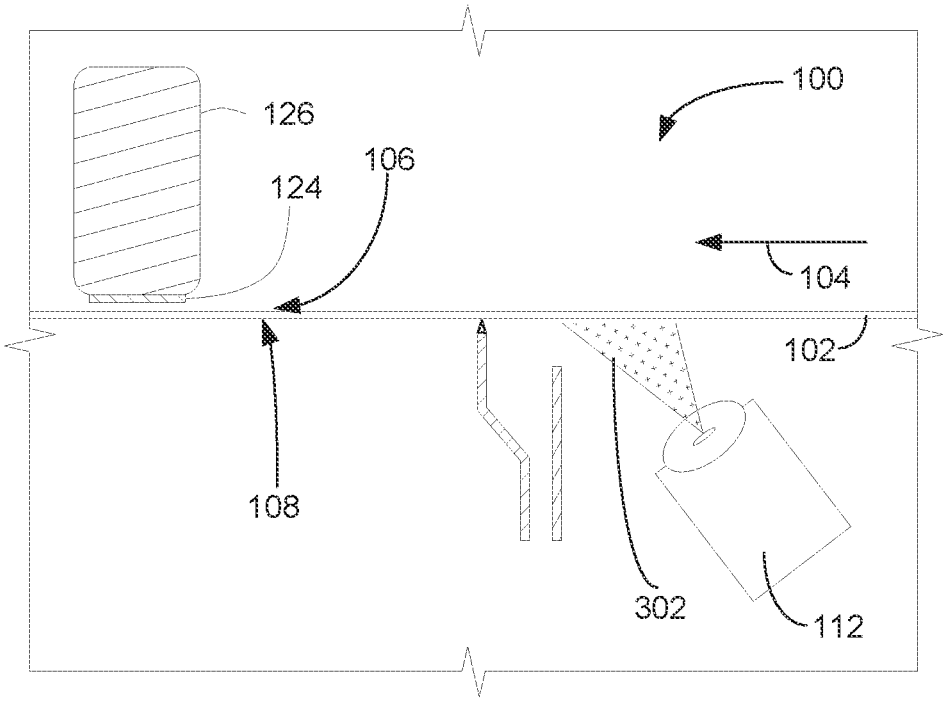
FIGS. 3A-3D are simple schematic diagrams that illustrate an example of a system for printhead cleaning.
Figure 3B:
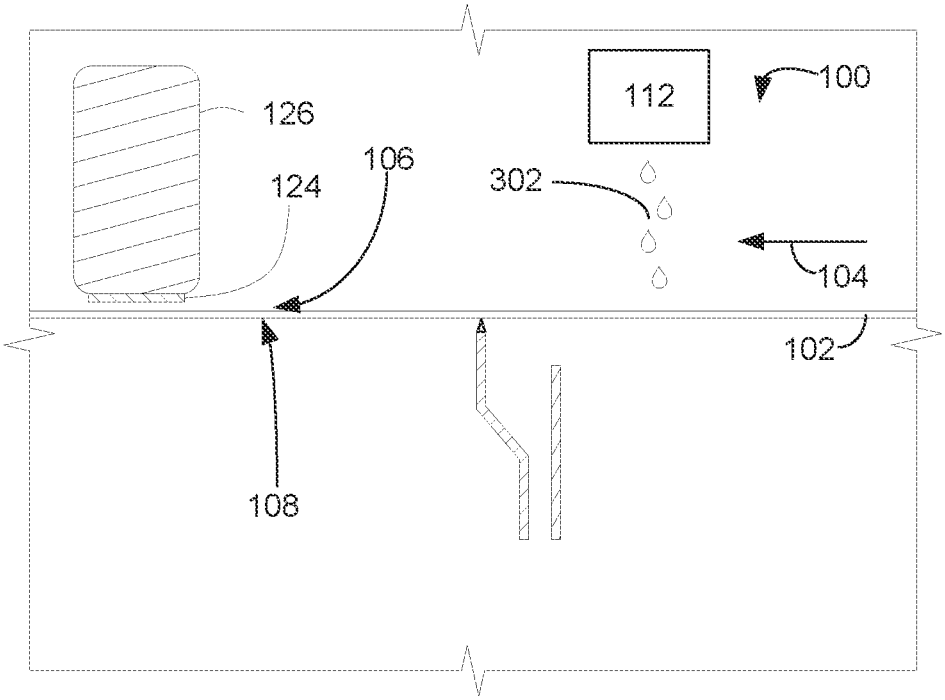

Moving to FIG. 3B, in certain examples of the disclosure printhead cleaning system 100 may include a liquid dispensing apparatus that is situated on first side 106 of cleaning web 102. In the example depicted in FIG. 3B, liquid dispensing apparatus 112 is a drip unit situated above web 102 to moisten web 102 by dripping a liquid 302 (e.g. via gravity feed) upon the cleaning web. In other examples, liquid dispensing apparatus 112 may jet liquid upon first side 106 to moisten cleaning web 102.

Figure 3C:
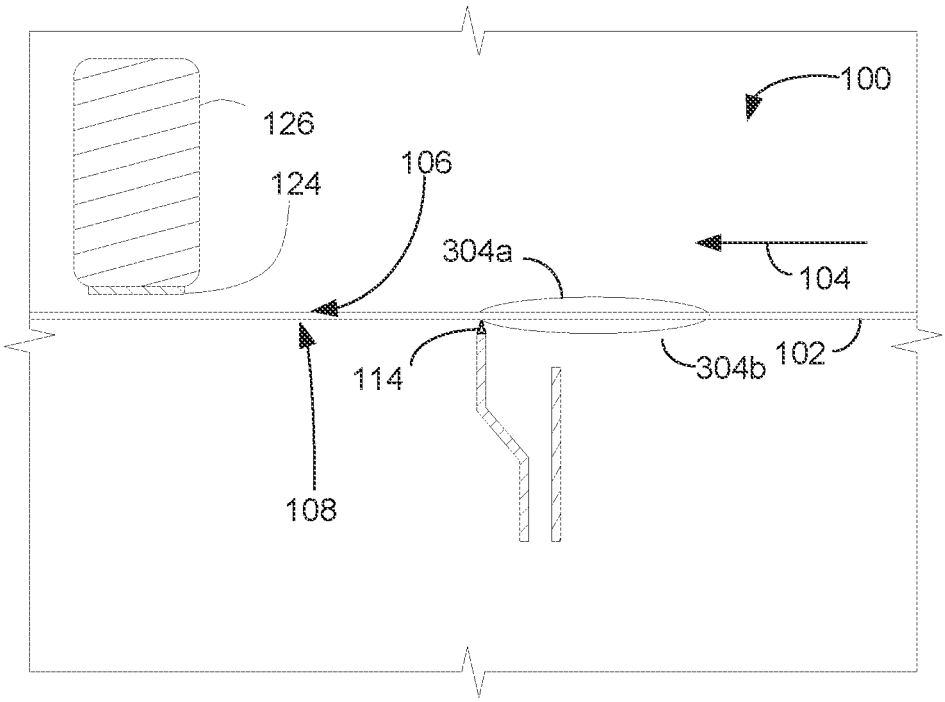

Moving to FIG. 3C, the dispensing apparatus having ejected liquid 302 onto cleaning web 102 (e.g., by second side 108 moistening as depicted in FIG. 3A or first side 106 moistening as depicted in FIG. 3B) has caused a pooling of excess liquid at web 102. In this example, the pooling of liquid is in the form of a first side pooling 304*a* and a second side pooling 304*b*. System 100 includes a scraper element 114 with a pointed or otherwise sharp edge that is to engage second side 108 of cleaning web 102 to scrape away excess liquid.

Figure 3D:
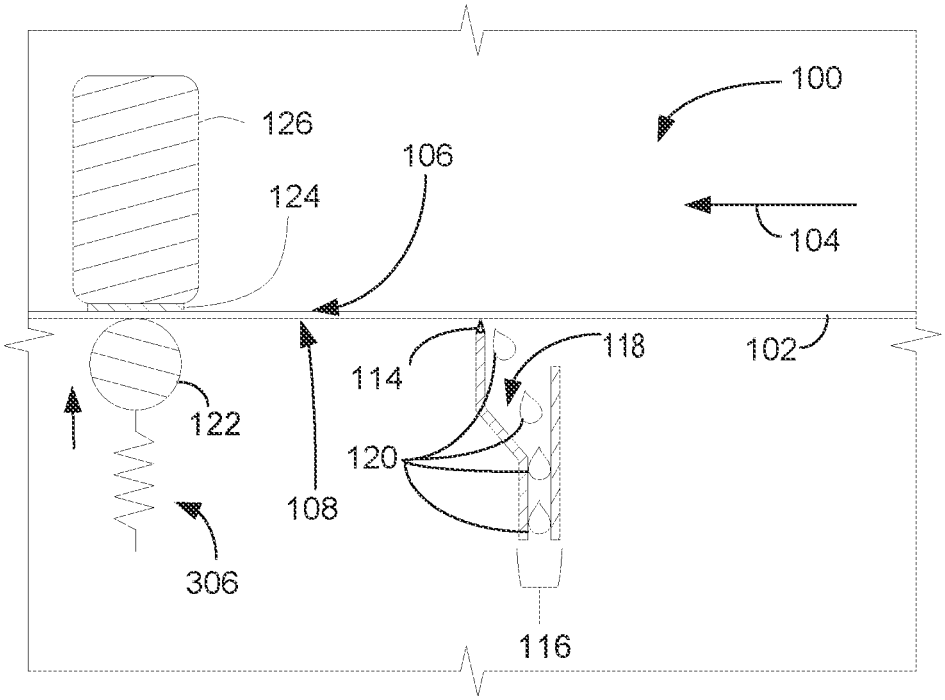

Moving to FIG. 3D, in this example scraper element 114 engages cleaning web 102 to cause removal of excess liquid 120 from first side 106 of cleaning web 102 as well as second side 108. In this example, a collector element 116 is positioned contiguous with the scraper element 114, and is to cause collection of the liquid 120 that was scraped from the cleaning web 102 by scraper element 114. In an example, scraper element 114 and collector element 116 may be formed as a single molded plastic component. In other examples, scraper element 114 and collector element 116 may be contiguous by virtue of the two elements being glued or otherwise adhered to one another. In particular examples, scraper element 114 is to rest upon or immediately above a part of the structure of collector element 116.

A pusher element 122 is movable into an engagement position to engage the second side 108 of cleaning web 102. In this example, a biasing device 306 is attached to pusher element 122 to urge the pusher element into second side 108 of cleaning web 102. Pusher element's 122 engagement of cleaning web 102 at second side 108 causes cleaning web 102 to be positioned such that first side 106 of the cleaning web wipes and cleans a face 124 of a printhead 126 as the web moves in the web direction 114. In examples, biasing device 306 may include one or more of a compression spring, an extension spring, or a torsion spring for urging pusher element 122 into second side 108 of cleaning web 102. In examples, first side 106 of cleaning web 102 engaging and cleaning printhead face 124 includes engaging and cleaning dried ink and/or other contaminants from a set of nozzles included within printhead face 124.

FIGS. 4A-4F are simple schematic diagrams that illustrate another example of a system for printhead cleaning. Beginning at FIG. 4A, in this example, printhead cleaning system 100 includes a web 102 of textile material that is movable in a web direction 104. Web 102 has first side 106 for wiping a printhead face and a second side 108 opposite the first side.

Figure 4A:
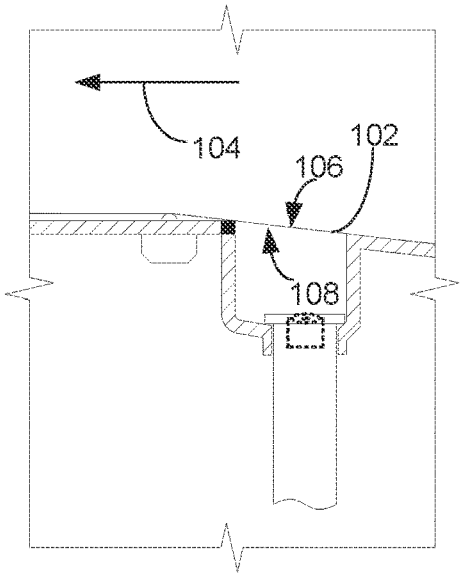
FIGS. 4A-4F are simple schematic diagrams that illustrate an example of a system for printhead cleaning.
Figure 4B:
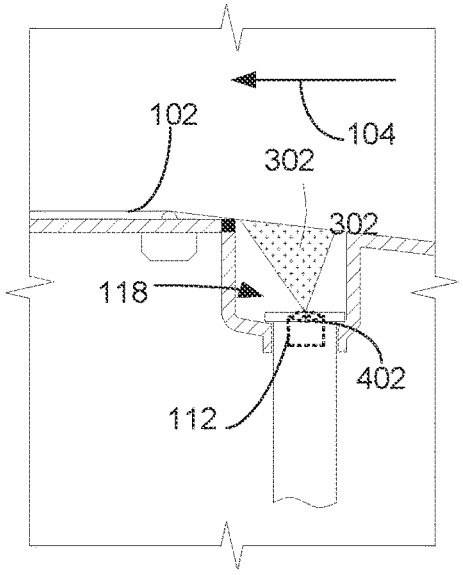

Moving to FIG. 4B, cleaning system 100 includes a dispensing apparatus 112 to dispense a liquid upon second side 108 of cleaning web 102. In this example, dispensing apparatus 112 is situated within a trough 118 that is part of a liquid collector element 116. Dispensing apparatus 112 includes a dispensing nozzle 402 positioned to face the second side of the cleaning web 102, such that liquid can be applied to the second side 108 via a jetting operation.

Figure 4C:
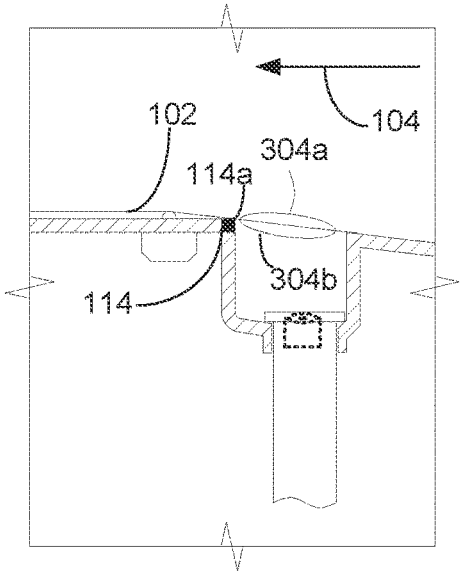

Moving to FIG. 4C, the dispensing apparatus having ejected liquid onto cleaning web 102 by second side 108 moistening, a pool of excess liquid is formed. In this example, the pooling of liquid is in the form of a first side pooling 304*a* and a second side pooling 304*b*. In other example, pooling of liquid at web 102 may be limited to first side pooling 304*a* or second side pooling 304*b*. System 100 includes a scraper element 114 with a pointed or otherwise sharp edge 114*a* that is to engage second side 108 of cleaning web 102 to scrape away excess liquid. Scraper element 114 is positioned adjacent to second side of cleaning web 102, downstream of dispensing apparatus 112, and upstream of the printhead face to be cleaned (see 124, FIGS. 4E and 4F) relative to web direction 104.

Figure 4D:
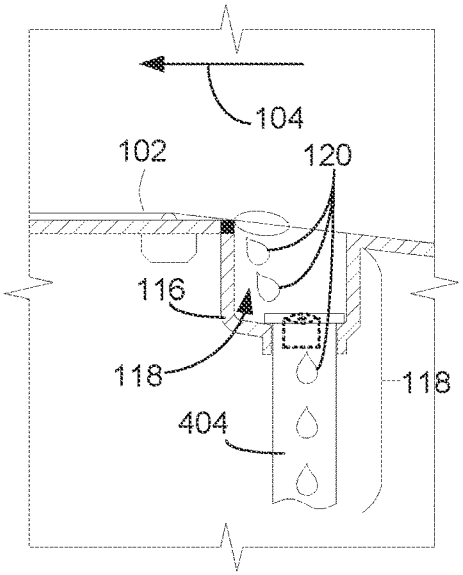

Moving to FIG. 4D, this example of a printhead cleaning system 100 includes a collector element 116 having a built-in trough 118. Collector element 116 is to cause collection of liquid 120 that has been scraped from cleaning web 102 by scraper element 114 into trough 118. In this example, collector element 116 includes a drain 404 situated at the bottom of trough 188. In an example, drain 404 is to connect to a disposal tank. In another example, drain 404 is to connect to a disposal tank a recirculation tank such that the collected liquid 120 may be recycled for use in a subsequent cleaning operation.

Figure 4E:
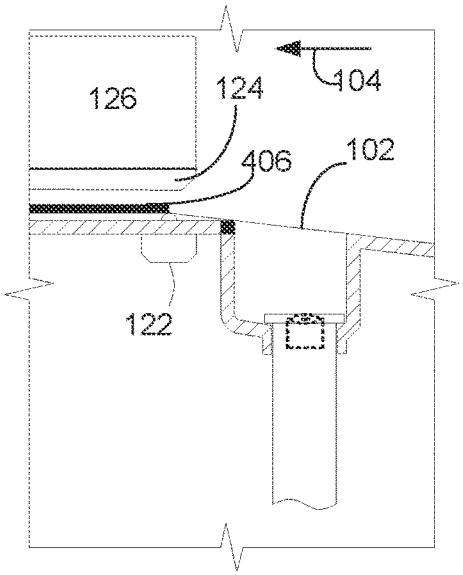
Figure 4F:
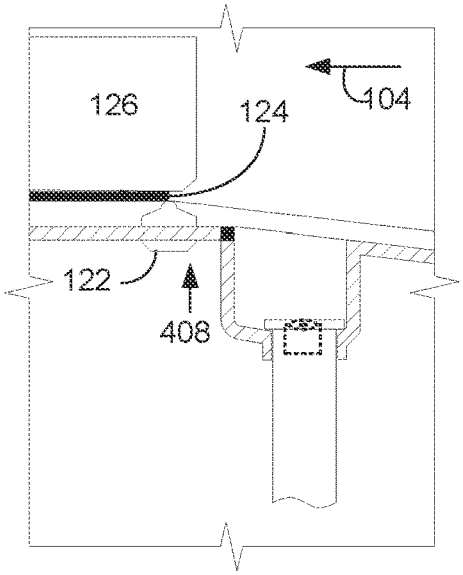

Moving to FIG. 4E, this example of a printhead cleaning system 100 includes a pusher element 122 for pushing against second side 108 of cleaning web 102. This pushing is to cause first side 106 of cleaning web 102 to wipe the face of a printhead. A length 406 of the web 102 in FIG. 4E has been marked with boldface to indicate that this length has an optimized liquid saturation level as a result of the utilization of scraper 114 with a sharp edge 114*a* (FIG. 4C) to scrape the web length at second side 108 and thereby transfer pooled liquid 304*a* and 304*b* (FIG. 4C) from the web length into collector element 116. In this FIG. 4E view, pusher element 122 has not yet moved towards a printhead face 124.

FIG. 4E illustrates movement of pusher element 122 in a direction 408 towards printhead 126 to accomplish pushing against second side 108 of cleaning web 102. This pushing is to cause first side 106 of cleaning web 102 to wipe the face 124, including printhead nozzles included therein, of a printhead 126. In this example, printhead 126 has also moved into a position adjacent to first side 106 of web 102 so as to be in place for the wiping operation.

Figure 5:
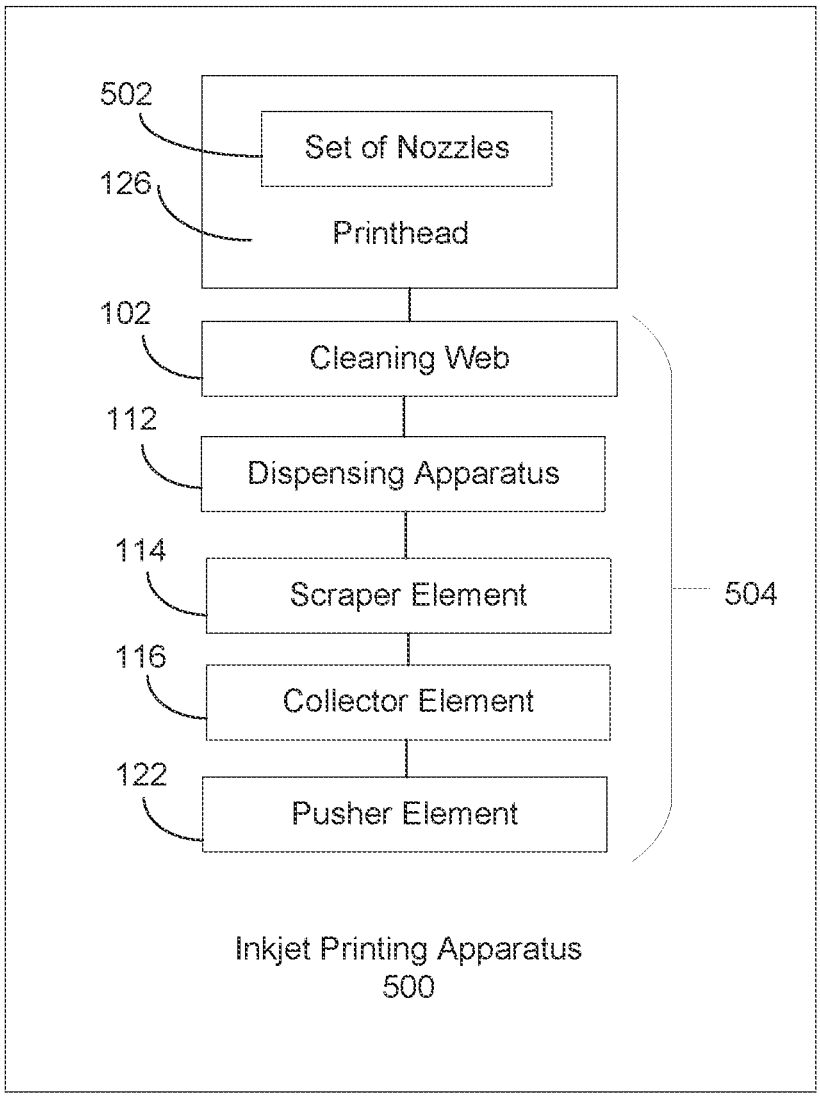
FIG. 5 is a block diagram depicting an example of an inkjet printing apparatus that includes a printhead service system.

FIG. 5 is a block diagram depicting an example of an inkjet printing apparatus that includes a printhead service system. In this example, inkjet printing apparatus 500 includes a printhead 126. As used herein an "inkjet printhead" refers to a printing technology wherein the printhead transfers ink to a substrate drop by drop. In examples, printhead 126 may be a thermal printhead (for thermal inkjet printing) or a piezo printhead (for piezoelectric printing). Printhead 126 includes a set of nozzles that are oriented to effect ejection of a print agent from printhead 126 onto a substrate to form a printed image (e.g., in the case where the print agent in an ink) or enhance printing of an image (e.g., in the case where the print agent is a primer applied to a substrate in advance of printing an image with ink, or in the case where the print agent is an overcoat or varnish applied to a substrate on top of an image printed with ink).

Inkjet printing apparatus 500 includes a printhead servicing system 504 that is to wipe accumulated contaminants, such as dried printing fluid or drying in, from set of nozzles 502 at the face of printhead 126. In an example, printhead service system 504 includes a cleaning web 102 that has a first web side to engage the set of nozzles 502 for wiping. In order to better clean set of nozzles 502, cleaning web 102 is to be moisturized with water or another cleaning fluid. A dispensing apparatus 112 included within printhead servicing system 504 is to apply the liquid.

Printhead servicing system 500 includes a scraper element 114 with a sharp edge to scrape a second side of the cleaning web, opposite the first side, and thereby cause removal of excess liquid from cleaning web 102. In particular examples, scraper element 114 scraping away liquid at the second side of web 102 will cause removal of excess liquid, e.g., pooled liquid, from both the first and second sides of web 102 as a result of porosity of the web medium and capillary effect.

Printhead servicing system 500 includes a collector element 116. In examples, collector element 116 may be situated contiguous with and beneath scraper element 114 adjacent to the second side of web 102, such that liquid scraped from the web 102 by scraper element 114 will migrate via gravity feed to a trough of collector element 116. In certain examples, the trough of collector element 116 may connect with a drain pipe, with the drain pipe leading to a disposal bin for the liquid or a recirculation unit for the liquid.

Printhead servicing system 500 includes a pusher element 116, sometimes known as a "wiper." In this example, pusher element 122 is repeatedly movable from a non-engaged position to a web-engagement position. In the web-engagement position pusher element 112 is to engage the second side of cleaning web 102, a thereby urge the first side of cleaning web 102 to wipe set of printhead nozzles 502. In the non-engaged position pusher element 122 is not engaging the second side of web 102. In an example, inkjet printing apparatus 500 is to, when printhead servicing is due or needed, bring printhead 126 adjacent to service servicing system 504 so that set of nozzles 502 is reachable by the first side of web 102 as pusher element engages the second side of web 102.

Figure 6:
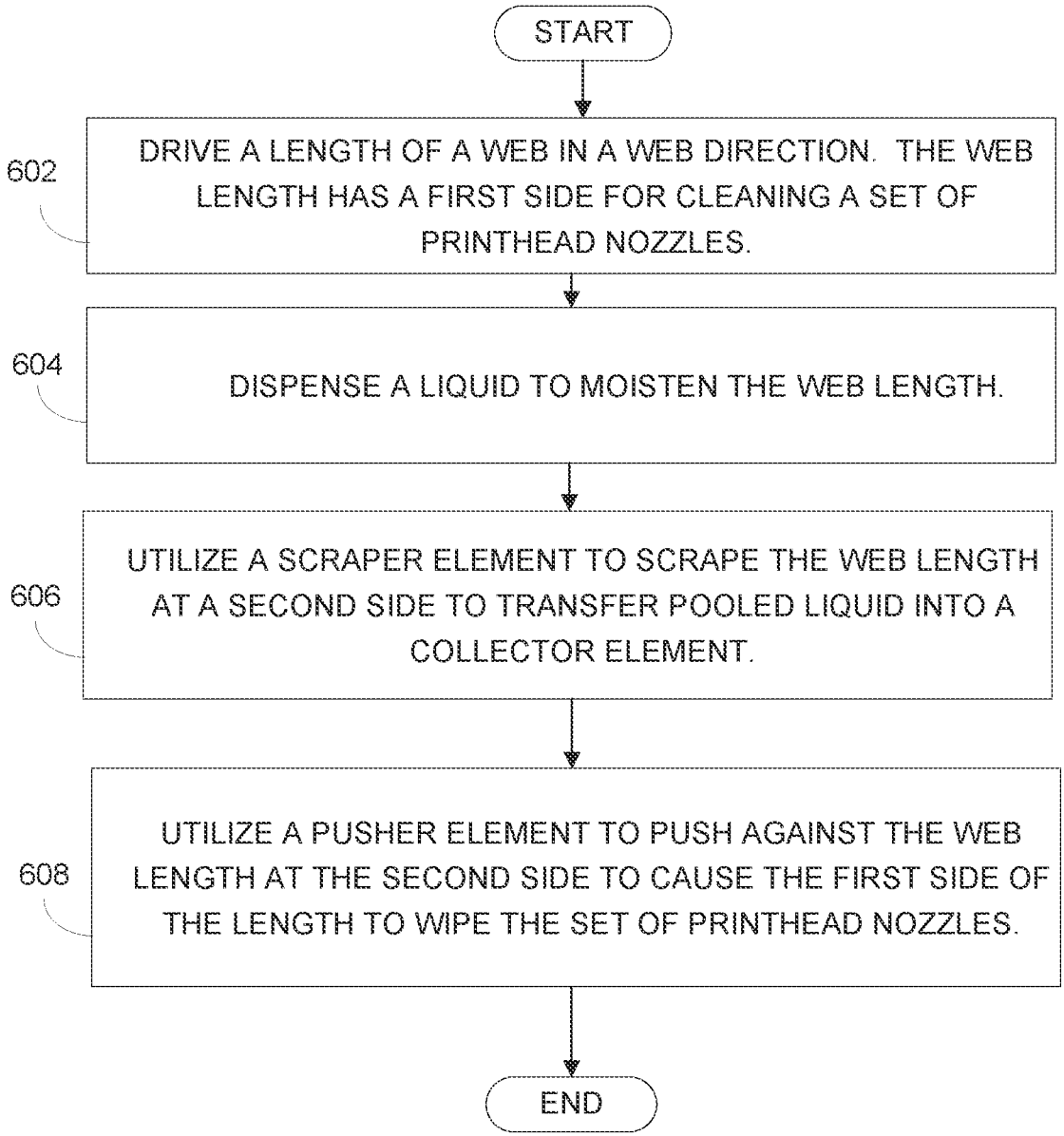
FIG. 6 is a flow diagram depicting an example implementation of a method for printhead cleaning.

FIG. 6 is a flow diagram depicting an example implementation of a method for printhead cleaning. In an example, a length of a web, is driven in in a web direction. The web has a first side for cleaning a set of printhead nozzles (block 602). A liquid is dispensed upon the web length to moisten the web length (block 604). A scraper element is utilized to scrape the web length at a second side to transfer pooled liquid into a collector element (block 606). A pusher element is utilized to push against the web length at the second side to cause the first side of the length to wipe the set of printhead nozzles (block 608).

In a certain example, a cleaning system (e.g., cleaning system 100, FIG. 1) may include a controller to implement the method of FIG. 6. For example, with respect to the cleaning system 100 of FIG. 1, a controller may cause the dispensing apparatus (112, FIG. 1) to dispense liquid upon a length of the web (102, FIG. 1), may cause the driving of the web 102 such that a scraper element (114, FIG. 1) scrapes pooled or otherwise excess liquid from the web length, and cause a pusher element (122, FIG. 1) to engage a second side 108 of web 102 to wipe a printhead face (124, FIG. 1).

In another certain example, an inkjet printing apparatus (e.g., inkjet printing apparatus 500, FIG. 5) that includes a printhead servicing system (e.g., 504, FIG. 5) may include a controller to implement the method of FIG. 6. For example, with respect to the printhead servicing system 500 of FIG. 5, a controller may cause the dispensing apparatus (112, FIG. 5) to drip or jet liquid upon a cleaning web (102, FIG. 5), may cause movement of the cleaning web 102 in a process direction such that a scraper element (114, FIG. 5) situated across the web scrapes pooled or otherwise excess liquid from the web length as the web moves, and may cause a pusher element (122, FIG. 5) to engage a second side of web 102 to urge the first side of web 102 to engage and wipe nozzles of the printhead as the web moves in the process direction (124, FIG. 1).

FIGS. 1, 2, 3A-3D, 4A-4F, 5, and 6 aid in depicting the architecture, functionality, and operation of various examples. In particular, FIGS. 1, 2, 3A-3D, 4A-4F, and 5 depict various physical and logical components. Various components are defined at least in part as programs or programming. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function(s). Examples can be realized in a memory resource for use by or in connection with a processing resource. A "processing resource" is an instruction execution system such as a computer/processor based system or an ASIC (Application Specific Integrated Circuit) or other system that can fetch or obtain instructions and data from computer-readable media and execute the instructions contained therein. A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

Although the flow diagram of FIG. 6 shows specific orders of execution, the order of execution may differ from that which is depicted. For example, the order of execution of two or more blocks or arrows may be scrambled relative to the order shown. Also, two or more blocks shown in succession may be executed concurrently or with partial concurrence. Such variations are within the scope of the present disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive. The terms "first", "second", "third" and so on in the claims merely distinguish different elements and, unless otherwise stated, are not to be specifically associated with a particular order or particular numbering of elements in the disclosure.

What is claimed is:

1. A cleaning system for a printhead, comprising:

a web of material that is movable in a web direction, the web having a first side of the web for wiping a printhead face and a second side of the web opposite the first side of the web;

a dispensing apparatus to dispense a liquid upon the web, wherein the dispensing apparatus is positioned on the second side of the web;

a scraper element to scrape the dispensed liquid from the web, the scraper element positioned adjacent to the second side of the web;

a collector element including a trough, the collector element to cause collection of the dispensed liquid from the web into the trough; and a pusher element to push against the second side of the web and cause the first side of the web to wipe the printhead face.

2. The system of claim 1, wherein the scraper element is situated across the web, downstream of the dispensing apparatus and upstream of the printhead face, and includes a sharp edge to scrape the dispensed liquid from the web.

3. The system of claim 1, wherein the scraper element and the collector element are contiguous.

4. The system of claim 1, wherein the dispensing apparatus is further to propel the dispensed liquid from the web upon the second side of the web.

5. The system of claim 4, wherein the dispensing apparatus is situated within the trough and includes a dispensing nozzle positioned to face the second side of the web.

6. The system of claim 1, wherein the dispensing apparatus is further to drip the dispensed liquid from the web upon the first side the web.

7. The system of claim 1, wherein the collector element includes a drain situated at a bottom of the trough, with the drain connecting to one of a disposal tank and a recirculation tank.

8. The system of claim 1, wherein the scraper element scraping the dispensed liquid from the web includes scraping pooled liquid from the second side of the web, which scraping also causes removal of liquid from the first side of the web due to porosity of the web and capillarity of the liquid.

9. The system of claim 1, wherein the printhead face includes a set of nozzles, and the wherein the first side of the web is to wipe the set of nozzles.

10. The system of claim 1, wherein the pusher element is movable between a first position Where the web cannot engage with the printhead face and a second position where the pusher element moves the web to a position where the web is to wipe the printhead face.

11. A method, comprising:

driving a length of a fabric web in a web direction, the fabric web having a first side for cleaning a set of printhead nozzles;

utilizing a dispensing element to dispense a liquid upon the length of the fabric web to moisten the length of the fabric web, wherein the dispensing apparatus is positioned on the first side of the web;

utilizing a scraper element with a sharp edge to scrape the length of the fabric web at a second side of the fabric web, opposite the first side of the web, to transfer poled liquid from the length of the fabric web into a collector element;

utilizing a pusher element to push against the length of the fabric web at the second side to cause the first side of the web to wipe the set of printhead nozzles.

12. The method of claim 11, wherein the dispensing the liquid further comprises jetting the liquid upon the second side of the fabric web or dripping the liquid upon the first side the fabric web.

13. The method of claim 11, wherein the collector element includes a trough with a connected drain pipe, and further comprising moving the pooled liquid to one of a disposal tank and a recirculation tank via the connected drain pipe.

14. The method of claim 11, further comprising implementing a wiping operation including moving a printhead that includes the printhead nozzles into a position adjacent to the web.

15. An inkjet printing apparatus, comprising:

a printhead including a set of nozzles;

a printhead service system, including:

a cleaning web with a first side to engage the set of nozzles;

a dispensing apparatus situated within a collector element, the dispensing apparatus to apply a liquid to moisten the cleaning web;

a collector element to cause collection of scraped liquid from the cleaning web; and a pusher element movable into a position to engage the second side of the cleaning web and urge first side of the cleaning web to wipe the set of nozzles.

16. The inkjet printing apparatus of claim 15, further comprising a scraper element with a sharp edge to scrape a second side of the cleaning web, wherein the scraper element is situated across the cleaning web and contiguous to the collector element.

17. The inkjet printing apparatus of claim 15, wherein the dispensing apparatus is further to propel liquid upon the second side of the cleaning web.

18. The inkjet printing apparatus of claim 17, wherein the dispensing apparatus is situated within a trough and includes a dispensing nozzle positioned to face the second side of the cleaning web.

19. The inkjet printing apparatus of claim 15, wherein the dispensing apparatus is further to drip liquid upon the first side the cleaning web.

20. The inkjet printing apparatus of claim 15, wherein the collector element includes a drain situated at a bottom of a trough, with the drain connecting to one of a disposal tank and a recirculation tank.

* * * * *